US005081943A

United States Patent [19]

Nakanishi

[11] Patent Number: 5,081,943

[45] Date of Patent: Jan. 21, 1992

[54] WORK FABRIC FEEDING DEVICE FOR AUTOMATIC SEWING APPARATUS

[75] Inventor: Fumio Nakanishi, Suzuka, Japan

[73] Assignee: Brother Kogyo Kabushiki Kaisha, Nagoya, Japan

[21] Appl. No.: 669,001

[22] Filed: Mar. 13, 1991

[30] Foreign Application Priority Data

May 8, 1990 [JP] Japan ..... 2-119614
May 21, 1990 [JP] Japan ..... 2-130851

[51] Int. Cl.[5] ..... D05B 21/00
[52] U.S. Cl. ..... 112/121.12
[58] Field of Search ..... 112/121.12, 121.15, 112/262.3, 304

[56] References Cited

U.S. PATENT DOCUMENTS

| | | | |
|---|---|---|---|
| 3,037,472 | 6/1962 | Lockwood | 112/121.12 X |
| 4,114,545 | 9/1978 | Manabe et al. | 112/121.15 |
| 4,406,234 | 9/1983 | Johnson et al. . | |
| 4,444,134 | 4/1984 | Maruyama et al. | 112/121.12 |
| 4,506,612 | 3/1985 | Yanagi | 112/121.12 |
| 4,563,960 | 1/1986 | Albrecht | 112/121.15 |
| 4,602,578 | 7/1986 | Yokoe et al. . | |
| 4,938,157 | 7/1990 | Scholl | 112/121.12 |
| 5,003,895 | 4/1991 | Talanker | 112/121.12 X |
| 5,005,501 | 4/1991 | Kita | 112/121.12 |
| 5,021,965 | 6/1991 | Olbrich | 112/121.12 X |

FOREIGN PATENT DOCUMENTS 50-68640 2/1981 Japan .
63-46195 2/1988 Japan .

*Primary Examiner*—Werner H. Schroeder
*Assistant Examiner*—Paul C. Lewis
*Attorney, Agent, or Firm*—Oliff & Berridge

[57] ABSTRACT

A work fabric feeding device for an automatic sewing apparatus which includes a sewing machine having a column portion, an arm extending from an upper end portion of the column portion in a first direction and a needle bar reciprocally supported at a free end portion of the arm, and which includes a table extending over the moving area of a work fabric to be sewn by the sewing machine is provided. The work fabric feeding device comprises: a beam having two end portions and being arranged below the arm and extending in a second direction perpendicular to the first direction, a support for movably supporting both end portions of the beam for movement in the first direction, a first moving mechanism arranged below the arm for moving the beam in the first direction directly below the arm from the column portion to the end portion containing the needle bar, a movable frame movably supported for movement in the second direction by the beam, a second moving mechanism arranged below the arm for moving the movable frame along the beam in the second direction, a work fabric holding frame movably mounted on the table for holding a work fabric, and a connector for connecting the work fabric holding frame to the movable frame.

15 Claims, 5 Drawing Sheets

WORK FABRIC FEEDING DEVICE FOR AUTOMATIC SEWING APPARATUS

BACKGROUND OF THE INVENTION

1. Field of the Invention

The present invention relates to a work fabric feeding device for an automatic sewing apparatus, and more particularly to a work fabric feeding device which is capable of moving a frame, for holding a work fabric, in an X-direction perpendicular to an arm of a sewing machine and in a Y-direction parallel to the arm of the sewing machine on a working table.

2. Description of the Related Art

An automatic sewing apparatus provided with a sewing machine for forming stitches and a work fabric feeding device for feeding a work fabric to a desired position so that any part of the work fabric may be sewn by the sewing machine is disclosed in U.S. Pat. No. 4,602,578. The work fabric feeding device is provided with a work fabric holding frame for holding the work fabric, an X-direction driving mechanism for moving the work fabric holding frame on a working table in an X-direction perpendicular to an arm of the sewing machine, and a Y-direction driving mechanism for moving the work fabric holding frame in a Y-direction perpendicular to the X-direction.

The X-direction driving mechanism and the Y-direction driving mechanism are provided such that they protrude forwardly from under the free end of the arm of the sewing machine which reciprocally supports a needle bar. Since the X-direction driving mechanism and Y-direction driving mechanism occupy a relatively large amount of space, the X-direction driving mechanism and the Y-direction driving mechanism protrude forwardly over a wide area from under the free end of the arm.

Accordingly, the automatic sewing apparatus has a very large size. Moreover, because the widely protruding X-direction and Y-direction driving mechanisms are obstructions, it is difficult for an operator to place a work fabric on the work fabric holding frame mounted on the table from the front side of the automatic sewing apparatus. Consequently, a working efficiency is reduced. The above mentioned problems are very serious especially in automatic sewing apparatus which are able to sew large sized work fabric. Because the work fabric feeding device for moving the large sized work fabric requires a large sized work fabric holding frame, a large sewing area is needed in order to sew a large sized work fabric. Therefore, the X-direction driving mechanism and the Y-direction driving mechanism become very large in size.

OBJECTS AND SUMMARY OF THE INVENTION

An object of the present invention is to provide a work fabric feeding device for an automatic sewing apparatus which allows the automatic sewing apparatus to have a compact size.

Another object of the present invention is to provide a work fabric feeding device for an automatic sewing apparatus in which a work fabric can be set easily on the work fabric holding frame mounted on a table, so that the working efficiency is increased.

To achieve the above and other objects, and to overcome the shortcomings discussed above, according to the present invention, a work fabric feeding device for an automatic sewing apparatus which includes a sewing machine having a column portion, an arm extending from an upper end portion of the column portion in a first direction and a needle bar reciprocally supported at a free end portion of the arm, and which includes a table extending over the moving area of a work fabric to be sewn by the sewing machine is provided. The work fabric feeding device comprises: guide means having two end portions and being arranged below the arm and extending in a second direction perpendicular to the first direction; supporting means for movably supporting both end portions of the guide means for movement in the first direction; first moving means arranged below the arm for moving the guide means in the first direction directly below the arm from the column portion to the end portion containing the needle bar; a movable frame movably supported for movement in the second direction by the guide means; second moving means arranged below the arm for moving the movable frame along the guide means in the second direction; a work fabric holding frame movably mounted on the table for holding a work fabric; and connecting means for connecting the work fabric holding frame to the movable frame.

In the work fabric feeding device according to the present invention, a work fabric is held by the work fabric holding frame movably mounted on the table. The work fabric holding frame is moved in the first direction through the movable frame and the connecting means as the guide means is moved by the first moving means. The work fabric holding frame is moved in the second direction through the connecting means as the movable frame is moved by the second moving means.

In the work fabric holding device according to the present invention, a driving mechanism of the work fabric feeding device does not protrude forward from the free end portion of the arm of the sewing machine over a wide area because the guide means, the first moving means and the second moving means are arranged below the arm and between the column portion of the sewing machine and the needle bar. Accordingly, the automatic sewing apparatus has a compact size. Moreover, a work fabric is easily set on the work fabric holding frame mounted on the table from the front side of the automatic sewing apparatus.

BRIEF DESCRIPTION OF THE DRAWINGS

A preferred embodiment of the present invention will be described in detail with reference to the following figures wherein.

DETAILED DESCRIPTION OF THE PREFERRED EMBODIMENTS

Figure 1:
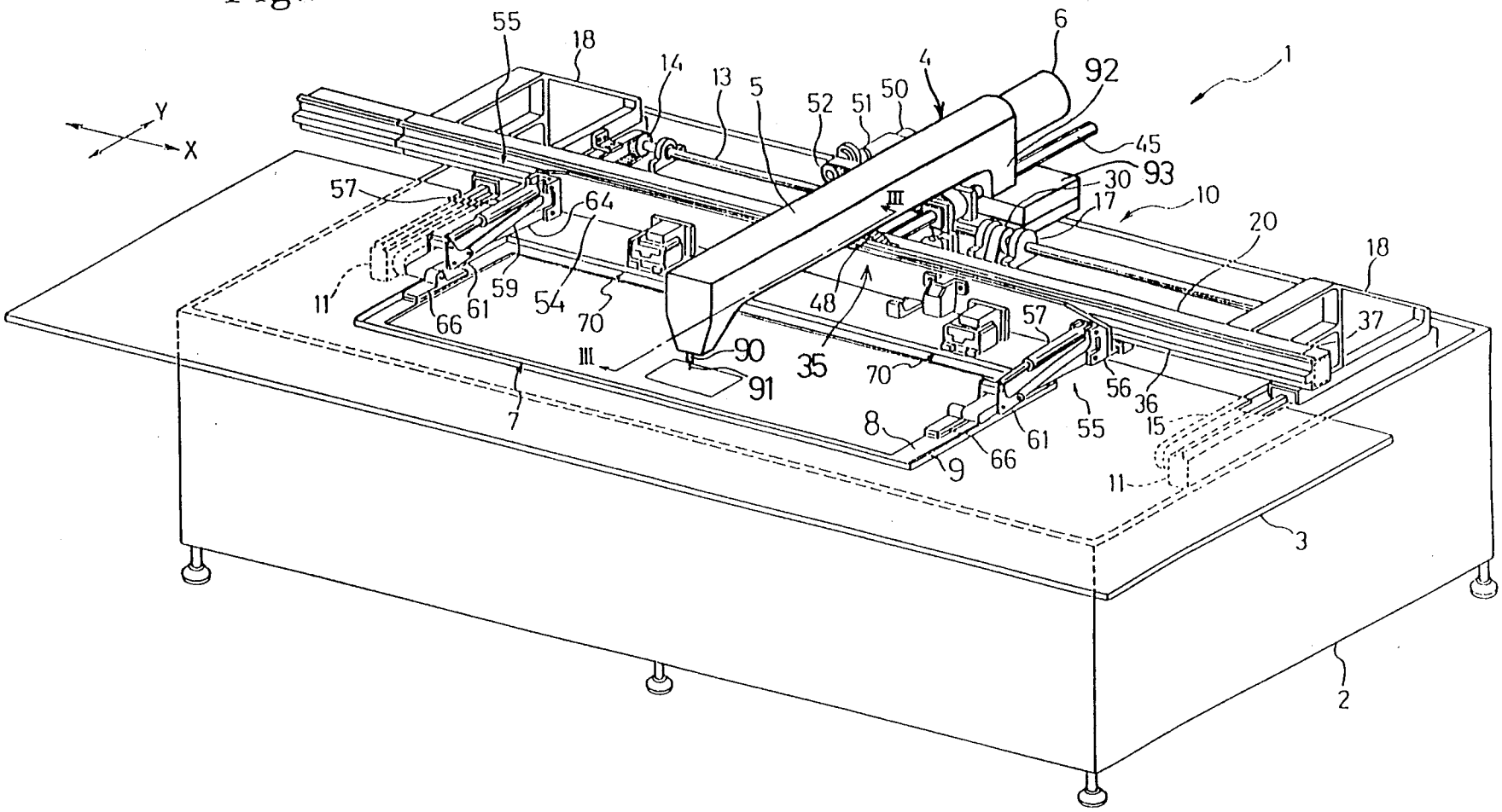
FIG. 1 is a perspective view of an automatic sewing apparatus according to a preferred embodiment of the present invention.
Figure 2:
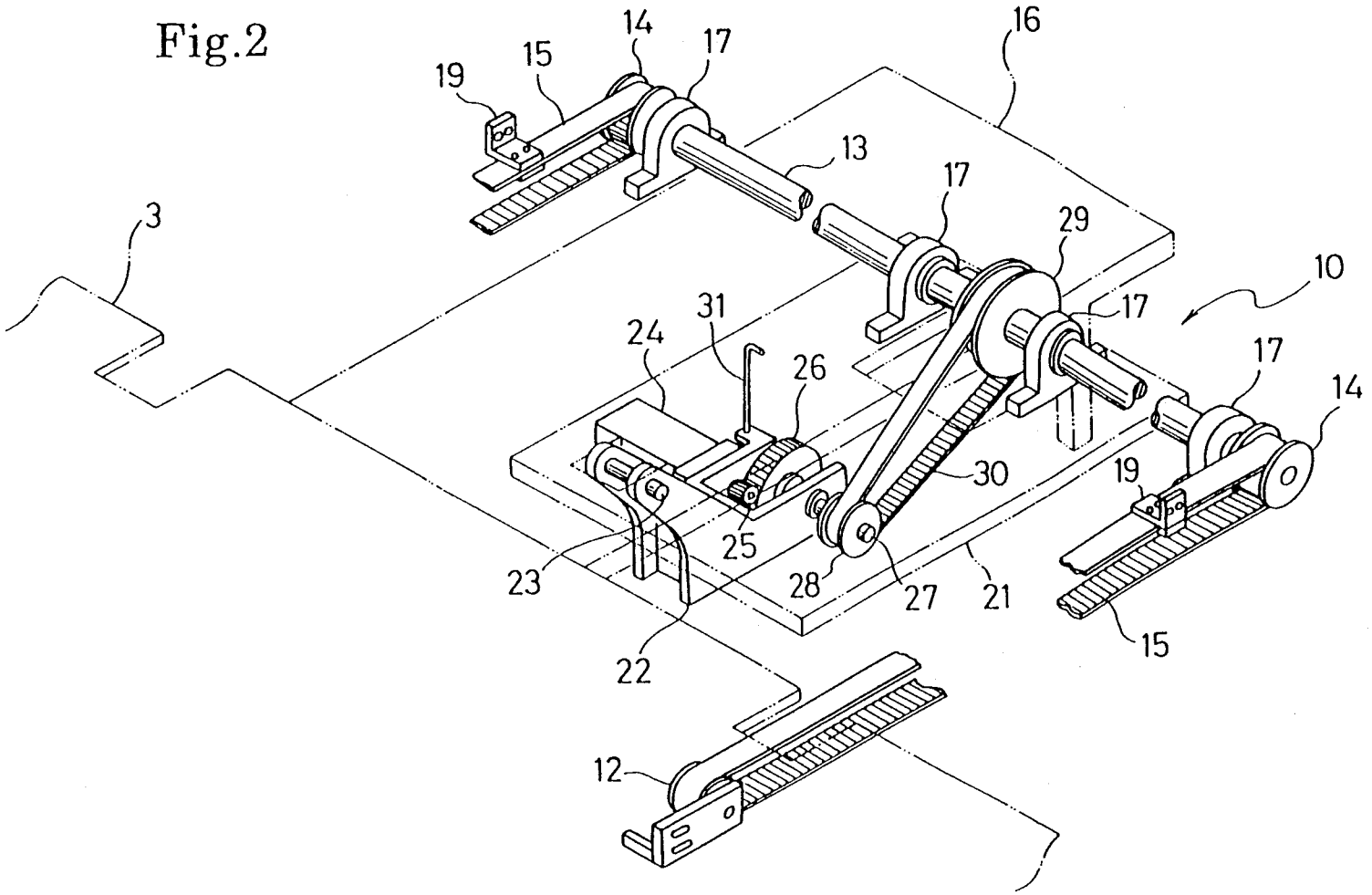
FIG. 2 is a perspective view, partially broken away, of a Y-direction driving mechanism in the work fabric feeding device of FIG. 1.

There will now be described a preferred embodiment of the present invention applied to a work fabric feeding device 1 for a large industrial automatic sewing apparatus. Referring to FIGS. 1 and 2, a working table 3 upon which a work fabric holding frame 7 can be placed is provided on a base 2 of the work fabric feeding device 1 for the large automatic sewing apparatus. A supporting stand 93 is fixed to a rear end portion of the base 2. A sewing machine 4 including a column portion 92 is fixed to the supporting stand 93 and also includes an arm 3. The arm 5 extends from an upper end portion of the column portion 92 toward a front side of the automatic sewing apparatus in a front or rear direction (Y-direction). Accordingly, the arm 5 is arranged above the table 3. A needle bar 90 having a needle 91 is movably supported in a free end of arm 5. A sewing machine motor 6 is mounted on the sewing machine 4. The sewing machine motor 6 drives a stitch forming mechanism which is provided in the sewing machine 4. The stitch forming mechanism includes the needle bar 90.

With reference to FIGS. 1 and 2, there will first be described a Y-direction driving mechanism 10 for moving the work fabric holding frame 7 in a front or rear direction (Y-direction). Work fabric holding frame 7 includes an upper presser member 8 and a lower base member 9 between which a work fabric is held. A pair of right and left guide rails 11 extending in the Y-direction are provided just under the table 3 near a right end portion and near a left end portion of the base 2, respectively. A pair of right and left pulleys 12 are rotatably supported to front end portions of the right and left guide rails 11, respectively. A Y-direction driving shaft 13 extending in a lateral direction (X-direction) is provided at the rear end portion of the base 2. A pair of right and left pulleys 14 are fixed to opposite ends of the Y-direction driving shaft 13. A pair of right and left timing belts 15 are wound around the right pulleys 12 and 14 and around the left pulleys 12 and 14, respectively. A first supporting plate 16 is provided behind the table 3. The Y-direction driving shaft 13 is rotatably supported by a plurality of bearings 17 mounted on the first supporting plate 16. A pair of right and left supporting frames 18 are laid on the right and left guide rails 11 so as to be movable in the Y-direction, respectively. The right and left supporting frames 18 are connected to the right and left timing belts 15, respectively, through a pair of right and left fixing members 19 which are opposed to each other. A movable beam 20 extending in the X-direction is provided above the table 3. The movable beam 20 is fixed at its right and left portions to the right and left supporting frames 18, respectively.

As shown in FIG. 2, a second supporting plate 21 is provided under the first supporting plate 16 behind the table 3. A swing frame 22 is pivotally supported at its upper end portion to the second supporting plate 21 by means of a pin 23. A Y-direction driving AC servo motor 24 is mounted on the swing frame 22. A driving gear 25 is fixed on a driving shaft of the AC servo motor 24. The driving gear 25 meshes with a driven gear 26 fixed on a rotating shaft 27 rotatably supported to the swing frame 22. A small-diameter pulley 28 is also fixed on the rotating shaft 27, and a large-diameter pulley 29 is fixed on the Y-direction driving shaft 13. A timing belt 30 is wound around the small-diameter pulley 28 and the large-diameter pulley 29. A tension of the timing belt 30 can be adjusted by a tension adjusting rod 31. Accordingly, when the AC servo motor 24 is driven, the right and left supporting frames 18 are synchronously moved in the Y-direction through the driving gear 25, the driven gear 26, the small-diameter pulley 28, the timing belt 30, the large-diameter pulley 29, the Y-direction driving shaft 13, the right and left timing belts 15 and the right and left fixing members 19. As a result, the movable beam 20 fixed to the right and left supporting frames 18 (which are fixed to timing belts 15 by fixing members 19) is moved in the Y-direction.

Figure 3:
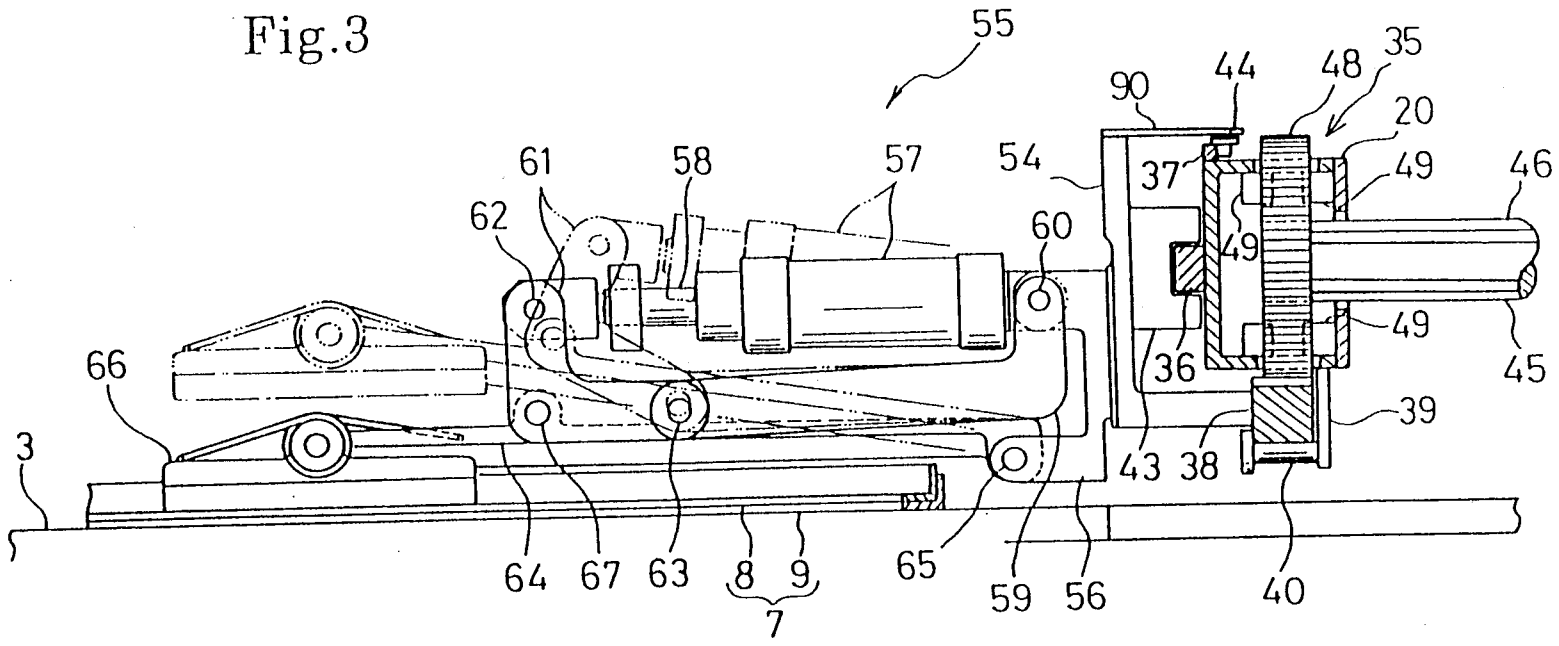
FIG. 3 is a cross section taken along the line III—III in FIG. 1.
Figure 5:
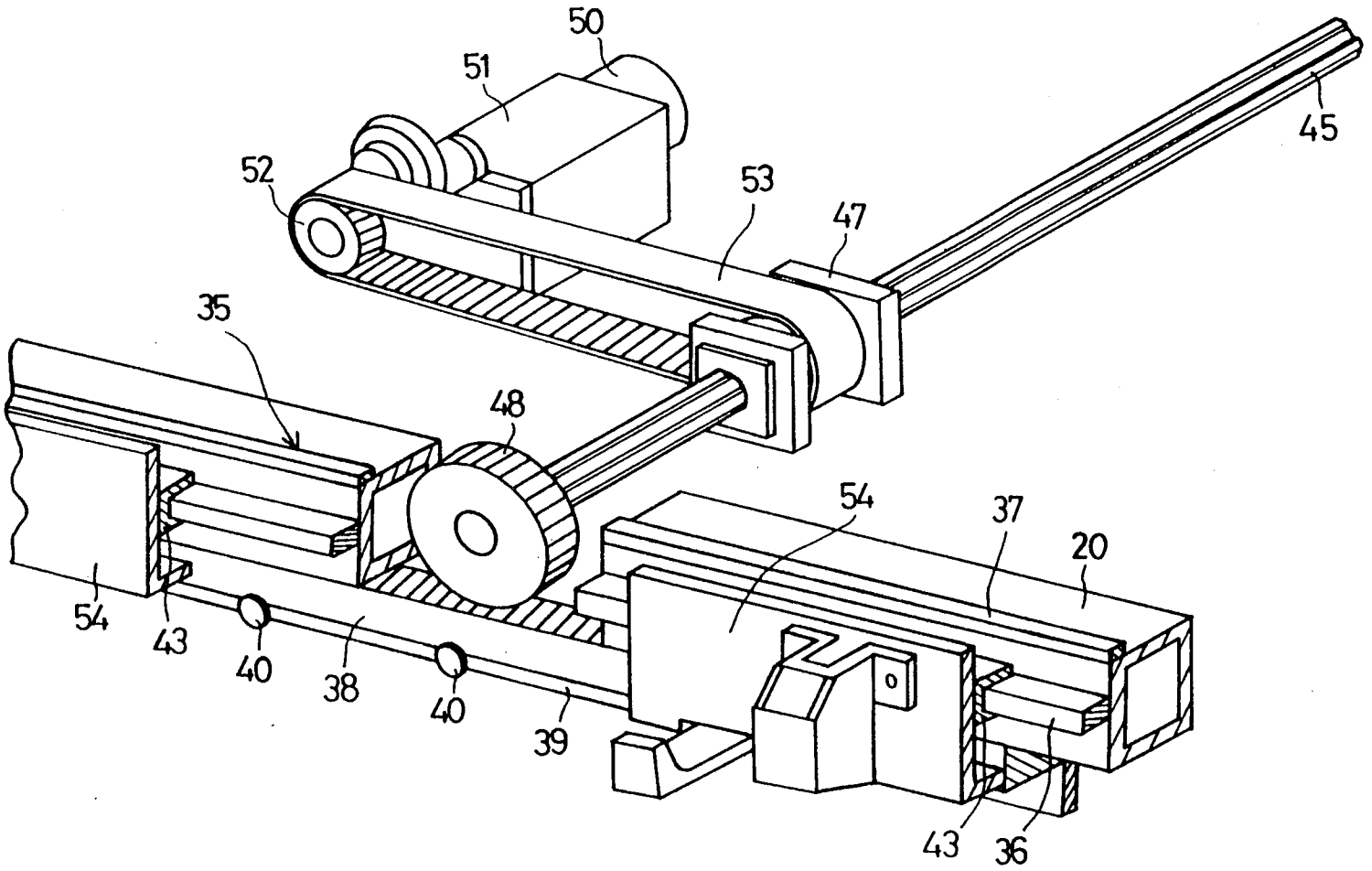
FIG. 5 is a perspective view, partially broken away, of an X-direction driving mechanism in the work fabric feeding device of FIG. 1.

Next, with reference to FIGS. 1, 3 and 5, there will be described an X-direction driving mechanism 35 for moving the work fabric holding frame 7 in the X-direction. A guide rail 36 is fixed to a front surface of the movable beam 20 at a vertically intermediate position thereof and extends the entire length of the movable beam 20. An auxiliary guide rail 37 is fixed to an upper surface of the movable beam 20 at a front end thereof in parallel relationship to the guide rail 36. A rack member 38 formed with a rack (teeth) on an upper surface thereof is provided just under the movable beam 20 in parallel relationship thereto. A plurality of flanged rollers 40 are rotatably mounted to a bracket 39 which is attached to and extends downwardly from a lower surface of the movable beam 20. Thus, the rack member 38 is supported by the flanged rollers 40 so as to be movable in the X-direction relative to the movable beam 20.

A movable frame 54 having a substantially L-shaped configuration in side view is provided in front of the movable beam 20 and the rack member 38 so as to extend in parallel relationship to the movable beam 20. The movable frame 54 is fixed at its lower end portion to the rack member 38 by bolts (not shown). A guide block 43 is fixed to the rear surface of the movable frame 54, and is slidably engaged with the guide rail 36. A plurality of brackets 90 are fixed to the upper end of the movable frame 54, respectively, and a flanged roller 44 for engaging the auxiliary guide rail 37 is rotatably mounted on the lower surface of each bracket 90.

An X-direction driving shaft 45 extending in the Y-direction is provided at a substantially central position of the movable beam 20 with respect to the X-direction. The X-direction driving shaft 45 is supported by the column portion 92 and a plurality of bearings 47 fixed on the base 2 so as to be rotatable and movable in the Y-direction. A front end portion of the X-direction driving shaft 45 is positioned in the movable beam 20, and a driving pinion 48 which meshes with the teeth of the rack member 38 is fixed to the front end portion of the X-direction driving shaft 45. Two pairs of movement restriction rollers 49 are rotatably mounted on the inside surface of the movable beam 20 so as to abut against front and rear surfaces of the driving pinion 48. Accordingly, the X-direction driving shaft 45 can be moved in the Y-direction so as to maintain a predetermined positional relationship with the rack member 38 in synchronism with the movement of the movable beam 20 in the Y-direction.

The X-direction driving shaft 45 is formed on its outer surface with a plurality of key ways 46 extending axially over the length of the driving shaft 45. Namely, the X-direction driving shaft 45 is a spline shaft. A driven pulley (not shown) having a key engaged with the key way 46 is provided just in front of the foremost bearing 47, and is mounted on the X-direction driving shaft 45 so as to be slidable thereon and so as to transmit a torque to the driving shaft 45. On the left side of the X-direction driving shaft 45, an X-direction driving AC servo motor 50 for driving the X-direction driving shaft 45 and a gear box 51 for reducing a rotational speed of the AC servo motor 50 are fixed to the base 2. A driving pulley 52 is fixed on a gear shaft (not shown) which is attached to a final gear of the gear box 51. A timing belt 53 is wound around the driving pulley 52 and the driven pulley mounted on the X-direction driving shaft 45. Accordingly, when the X-direction driving AC servo motor 50 is driven, the driving pinion 48 is rotationally driven through the gear box 51, the driving pulley 52, the timing belt 53, the driven pulley and the X-direction driving shaft 45. The rotation of the driving pinion 48 causes rightward or leftward movement of the rack member 38 and the movable frame 54, as a unit, along the movable beam 20 while being guided by the guide rail 36 and the auxiliary guide rail 37.

Next, with reference to FIGS. 1 and 3, there will be described a pair of right and left frame lifting mechanisms 55 for vertically moving the upper presser member 8 of the work fabric holding frame 7. The right and left frame lifting mechanisms 55 are mounted on a right end portion and left end portion of the movable frame 54, respectively. Since both the frame lifting mechanisms 55 have the same structure, the following description will be directed solely to the left frame lifting mechanism 55.

A mounting member 56 having a U-shaped configuration in both plan and side views is fixed to the front surface of the movable frame 54. An air cylinder 57 is pivotally supported at its base end through a pin 60 to an upper end portion of the mounting member 56. Further, a first pivotal member 59 having an L-shaped configuration in side view is also pivotally supported at its rear end through the pin 60 to the upper end portion of the mounting member 56. A piston rod 58 of the air cylinder 57 is pivotally supported at its front end through a pin 62 to an upper end of a connecting member 61 having an L-shaped configuration in side view. A rear end of the connecting member 61 is pivotally connected through a pin 63 to a front end of the first pivotal member 59. A second pivotal member 64 for lifting the upper presser member 8 is pivotally supported at its rear end through a pin 65 to a lower end portion of the mounting member 56. A front end of the second pivotal member 64 is pivotally connected to a mounting plate 66 mounted on the upper presser member 8. The second pivotal member 64 is also pivotally supported at an intermediate position thereof through a pin 67 to an angular portion of the L-shaped connecting member 61. Accordingly, when the air cylinder 57 is driven to retract the piston rod 58, the connecting member 61 is rotated clockwise as viewed in FIG. 3, and the front end portion of the second pivotal member 64 is therefore lifted. As a result, the mounting plate 66 and the upper presser member 8 are lifted from a work fabric holding position shown by a solid line to a work fabric releasing position shown by a phantom line.

Figure 4:
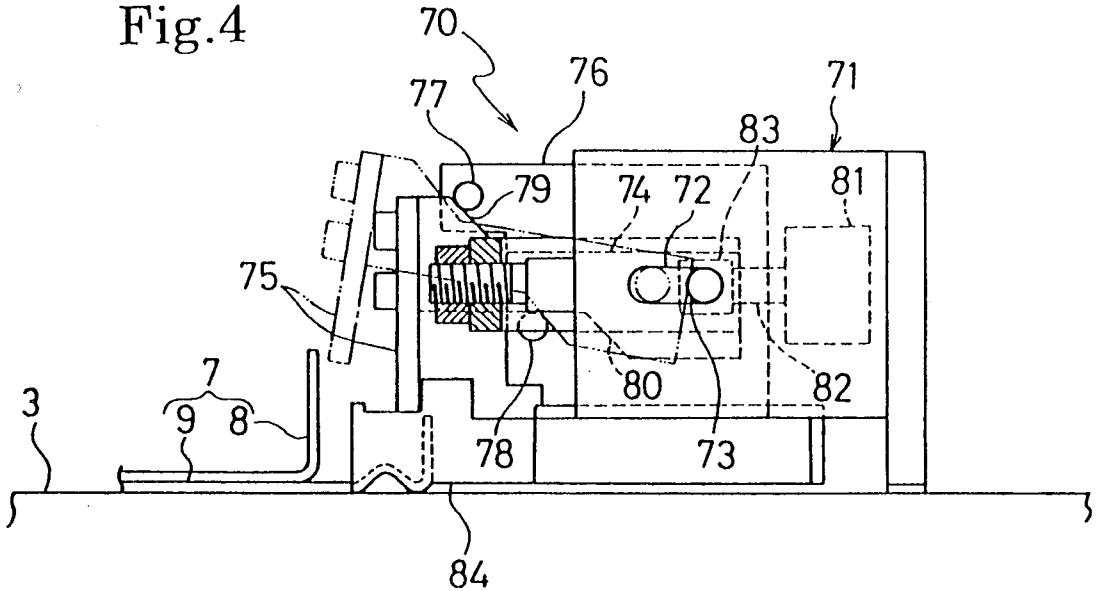
FIG. 4 is a side view of a clamping mechanism for clamping a work fabric holding frame.

Next, with reference to FIGS. 1 and 4, there will be described a pair of right and left frame clamping mechanisms 70 for detachably clamping the lower base member 9 of the work fabric holding frame 7 to the movable frame 54. The right and left frame clamping mechanisms 70 are mounted on the front surface of the movable frame 54, respectively. Since both the frame clamping mechanisms 70 have the same structure, the following description will be directed solely to the left frame clamping mechanism 70.

A supporting case 71 is mounted on the movable frame 54. Right and left walls of the supporting case 71 are formed with a pair of elongated holes 72, respectively. A pair of right and left cam members 74 are fixed at their rear ends to a pin 73 which is inserted in the elongated holes 72. A clamping pawl 75 is mounted on the front ends of the cam members 74. A pair of right and left fixed plates 76 are provided just inside the right and left walls of the supporting case 71. An upper operating pin 77 and a lower operating pin 78 are fixed to the fixed plates 76. The upper operating pin 77 is engageable with first inclined surfaces 79 of the cam members 74, and the lower operating pin 78 is engageable with second inclined surfaces 80 of the cam members 74. An air cylinder 81 is provided in the supporting case 71. A piston rod 82 of the air cylinder 81 is connected at its front end to a block 83 which is fixed to the pin 73. Accordingly, when the air cylinder 81 is driven to advance the piston rod 82, the cam members 74 are first moved to the front side by a small distance, so that the clamping pawl 75 moves forwardly (to the left in FIG. 4). Forward movement of clamping pawl 75 releases a clamping member 84, fixed to a rear end of the lower base member 9, from a clamping position shown by solid line, thereby releasing a clamping condition of the lower base member 9. Then, the cam members 74 are upwardly rotated by the engagement of the second inclined surfaces 80 with the lower operating pin 78. In contrast, when the piston rod 82 is retracted, the cam members 74 are downwardly rotated by the engagement of the first inclined surfaces 79 with the upper operating pin 77, and the clamping pawl 75 comes into engagement with the clamping member 84. Then, the clamping member 84 is moved to the clamping position by the rearward movement of the cam members 74, thereby clamping the lower base member 9.

According to the present invention, movable beam 20 functions as a guide means for guiding the movement of a work fabric to be sewn by sewing machine 4. Supporting frames 18 and guide rails 11 function as supporting means for movably supporting movable beam 20 in the Y-direction. Driving mechanism 10 functions as first moving means for moving beam 20 in the Y-direction. Driving mechanism 35 functions as a second moving means for moving movable frame 54 in the X-direction. Mounting plates 66 and clamping mechanisms 70 function as connecting means for connecting work fabric holding frame 7 to movable frame 54. Pulleys 12 and 14 and timing belts 15 function as first converting means for converting rotational motion of first driving shaft 13 into linear motion of supporting frames 18 in the Y-direction. Rack member 38 and pinion 48 function as a second converting means for converting rotational motion of second driving shaft 45 into linear motion of movable frame 54 in the X-direction. While specific structural examples have been described above, these examples describe a preferred embodiment of the invention and are meant to be illustrative, not limiting.

In the work fabric feeding device 1 for an automatic sewing apparatus as mentioned above, since the X-direction driving mechanism 35 and the Y-direction driving mechanism 10 are located below the arm 5, between column 92 and needle bar 91, and on the side of the column portion 92, the automatic sewing apparatus can be made compact, and the operability thereof can be improved.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A work fabric feeding device for an automatic sewing apparatus including a sewing machine having a column portion, an arm extending from an upper end portion of said column portion in a first direction and a needle bar reciprocally supported at a free end portion of said arm, and a table extending over a moving area of a work fabric to be sewn by said sewing machine, said work fabric feeding device comprising:

guide means for guiding the work fabric on the table, said guide table having two end portions and being arranged directly below said arm and extending in a second direction perpendicular to the first direction;

supporting means for movably supporting said two end portions of said guide means for movement of said guide means in the first direction directly below said arm between said column and said needle bar;

first moving means arranged directly below said arm for moving said guide means in the first direction;

a movable frame movably supported by said guide means for movement in the second direction;

second moving means arranged directly below said arm for moving said movable frame relative to and along said guide means in the second direction, said second moving means including a second driving shaft extending in the first direction and inserted through said column portion of said sewing machine so that said second driving shaft penetrates through and is reciprocally supported by said column portion, a second driving motor for rotating said second driving shaft, and a second converting means for converting rotational motion of said second driving shaft into linear motion of said movable frame in said second direction;

a work fabric holding frame movably mounted on said table for holding a work fabric; and connecting means for connecting said work fabric holding frame to said movable frame.

2. The work fabric feeding device according to claim 1, wherein said guide means is arranged above said table.

3. The work fabric feeding device according to claim 1, wherein said supporting means includes a pair of supporting units, one supporting unit for each end portion of said guide means, each of said supporting units having a supporting frame to which a corresponding one of said end portions of said guide means is fixed and a guide rail extending in the first direction on which a corresponding one of said supporting frames is slidably mounted for movement in the first direction.

4. The work fabric feeding device according to claim 3, wherein said first moving means includes a first driving shaft extending in the second direction, a first driving motor drivably engaged with said first driving shaft for rotating said first driving shaft, and a pair of first converting means for converting rotational motion of said first driving shaft into linear motion of said supporting frames in said first direction.

5. The work fabric feeding device according to claim 1, wherein said second converting means includes a pinion fixed to one end of said second driving shaft and rotatably supported in a central portion of said guide means, and a rack member movably supported by said guide means for movement in the second direction and which is attached to and driven by said pinion and is connected to said movable frame.

6. The work fabric feeding device according to claim 1, wherein said guide means is a beam extending in the second direction.

7. The work fabric feeding device of claim 4, wherein said first driving shaft extends substantially an entire distance between each of said supporting frames, and wherein each of said first converting means comprises:

a driving pulley attached to a corresponding end of said first driving shaft;

a driven pulley rotatably mounted below the table and located forward of the driving pulley in the first direction;

a timing belt surrounding the driven and driving pulleys for being rotated thereby; and a fixing member attaching said timing belt to a corresponding support frame.

8. The work fabric feeding device of claim 7, further comprising a second timing belt rotatably connecting said first driving shaft to a shaft of said first driving motor near a center of said first driving shaft.

9. The work fabric feeding device of claim 1, further comprising a timing belt rotatably connecting said second driving shaft to a shaft of said second driving motor, wherein said second driving motor is located to a side of said column.

10. The work fabric feeding device of claim 4, wherein said second driving shaft crosses over said first driving shaft at a substantially central portion of said first driving shaft.

11. An automatic sewing apparatus comprising:

a sewing machine having a column portion, an arm extending from an upper end portion of said column portion in a first direction, and a needle bar reciprocally supported at a free end portion of said arm;

a table extending over a moving area of a work fabric to be sewn by said sewing machine; and a work fabric feeding device including:

a guide member having two end portions, said guide member being arranged directly below said arm and extending in a second direction perpendicular to the first direction;

supporting means for movably supporting said two end portions of said guide member for movement of said guide member in the first direction directly below said arm between said column and said needle bar, said supporting means including a pair of supporting units, one supporting unit for each end portion of said guide means, each of said supporting units having a supporting frame to which a corresponding one of said end portions of said guide means is fixedly attached and a guide rail extending in the first direction on which a corresponding one of said supporting frames is slidably mounted for movement in the first direction;

first moving means arranged directly below said arm for moving said guide member in the first direction, said first moving means including a first driving shaft extending in the second direction, a single first driving motor for rotating said first driving shaft, and a pair of first converting means for converting rotational motion of said first driving shaft into linear motion of said supporting frames in the first direction, said first driving shaft extending substantially an entire distance between each of said supporting frames, each of said first converting means including a drive pulley attached to a corresponding end of said first driving shaft, a driven pulley rotatably mounted below the table and located forward of the drive pulley in the first direction, a timing belt surrounding the driven and drive pulleys for being rotated thereby, and a fixing member attaching said timing belt to a corresponding support frame, said single first driving motor being located to a side of said arm, and a second timing belt attached between said first driving motor and a central portion of said first driving shaft;

a movable frame movably supported by said guide member for movement in the second direction;

second moving means arranged directly below said arm for moving said movable frame relative to and along said guide member in the second direction; and connecting means for connecting said movable frame to a work fabric holding frame.

12. The apparatus of claim 11, wherein said guide member is a straight beam arranged above said table.

13. An automatic sewing apparatus comprising:

a sewing machine having a column portion, an arm extending from an upper end portion of said column portion in a first direction, and a needle bar reciprocally supported at a free end portion of said arm;

a table extending over a moving area of a work fabric to be sewn by said sewing machine; and a work fabric feeding device including:

guide means for guiding the work fabric on the table, said guide means having two end portions and being arranged directly below said arm and extending in a second direction perpendicular to the first direction;

supporting means for movably supporting said two end portions of said guide means for movement of said guide means in the first direction directly below said arm between said column and said needle bar, said supporting means including a pair of supporting units, one supporting unit for each end portion of said guide means, each of said supporting units having a supporting frame to which a corresponding one of said end portions of said guide means is fixedly attached and a guide rail extending in the first direction on which a corresponding one of said supporting frames is slidably mounted for movement in the first direction;

first moving means arranged directly below said arm for moving said guide means in the first direction, said first moving means including a first driving shaft extending in the second direction, a single first driving motor for rotating said first driving shaft, and a pair of first converting means for converting rotational motion of said first driving shaft into linear motion of said supporting frames in the first direction, said first driving shaft extending substantially an entire distance between each of said supporting frames, each of said first converting means including a drive pulley attached to a corresponding end of said first driving shaft, a driven pulley rotatably mounted below the table and located forward of the drive pulley in the first direction, a timing belt surrounding the driven and drive pulleys for being rotated thereby, and a fixing member attaching said timing belt to a corresponding support frame, said single first driving motor being located to a side of said arm, and a second timing belt attached between said first driving motor and a central portion of said first driving shaft;

a movable frame movably supported by said guide means for movement in the second direction;

second moving means arranged below said arm for moving said movable frame relative to and along said guide means in the second direction, said second moving means including a second driving shaft located directly below said sewing machine arm and extending in the first direction, a second driving motor for rotating said second driving shaft and a second converting means for converting rotational motion of said second driving shaft into linear motion of said movable frame in said second direction, said second driving shaft crossing over said first driving shaft at a substantially central portion of said first driving shaft; and connecting means for connecting said movable frame to a work fabric holding frame.

14. The apparatus of claim 13, wherein said guide means is a straight beam arranged above said table.

15. The apparatus of claim 13, wherein said second converting means includes a pinion fixed to one end of said second driving shaft and rotatably supported in a central portion of said guide means, and a rack member movably supported by said guide means for movement in the second direction and which is attached to and driven by said pinion and is connected to said movable frame, a third timing belt rotatably connecting said first driving shaft to a shaft of said second driving motor wherein said second driving motor is located to the side of said arm.

* * * * *